US007823552B2

(12) United States Patent
Kwon et al.

(10) Patent No.: US 7,823,552 B2
(45) Date of Patent: Nov. 2, 2010

(54) CONTINUOUS VARIABLE VALVE LIFT APPARATUS

(75) Inventors: Kiyoung Kwon, Seoul (KR); Young Hong Kwak, Suwon (KR); Ki Uk Shin, Hwaseong (KR); Kyoung Joon Chang, Seongnam (KR); Jin Kook Kong, Suwon (KR)

(73) Assignee: Hyundai Motor Company, Seoul (KR)

( * ) Notice: Subject to any disclaimer, the term of this patent is extended or adjusted under 35 U.S.C. 154(b) by 375 days.

(21) Appl. No.: 11/966,062

(22) Filed: Dec. 28, 2007

(65) Prior Publication Data

US 2009/0031971 A1 Feb. 5, 2009

(30) Foreign Application Priority Data

Aug. 1, 2007 (KR) ..... 10-2007-0077404
Nov. 19, 2007 (KR) ..... 10-2007-0118035

(51) Int. Cl.
*F01L 1/34* (2006.01)

(52) U.S. Cl. ..... 123/90.16; 123/90.15; 74/559; 74/569

(58) Field of Classification Search ..... 123/90.15, 123/90.16; 7/569, 559, 567
See application file for complete search history.

(56) References Cited

U.S. PATENT DOCUMENTS

2006/0243233 A1* 11/2006 Fujita et al. ..... 123/90.16

FOREIGN PATENT DOCUMENTS

KR 10-0772012 B1 10/2007

* cited by examiner

*Primary Examiner*—Zelalem Eshete
(74) *Attorney, Agent, or Firm*—Morgan, Lewis & Bockius LLP

(57) ABSTRACT

A continuous variable valve lift apparatus includes an input cam disposed on an input shaft, a valve opening/closing portion, and a rocker arm rotating shaft. A rocker arm rotates around the rocker arm rotating shaft corresponding to a rotation of the input cam. An output cam is disposed at an end of the rocker arm, and opens and closes the valve opening/closing portion. A control portion controls a position of the rocker arm rotating shaft.

20 Claims, 11 Drawing Sheets

(a)

(b)

CONTINUOUS VARIABLE VALVE LIFT APPARATUS

CROSS-REFERENCE TO RELATED APPLICATION

This application claims priority to and the benefit of Korean Patent Application No. 10-2007-0118035, filed in the Korean Intellectual Property Office on Nov. 19, 2007, and Korean Patent Application No. 10-2007-0077404 filed in the Korean Intellectual Property Office on Aug. 1, 2007, the entire contents of which are incorporated herein by reference.

BACKGROUND OF THE INVENTION (a) Field of the Invention

The present invention relates to a continuous variable valve lift apparatus. More particularly, the present invention relates to a continuous variable valve lift apparatus that can adjust a valve lift amount in response to an operational state of an engine.

(b) Description of the Related Art

A typical combustion chamber of an automotive engine is provided with an intake valve for supplying the air/fuel mixture and an exhaust valve for expelling the burned gas. The intake and exhaust valves are opened and closed by a valve lift apparatus connected to a crankshaft.

A conventional valve lift apparatus has a fixed valve lift amount due to a fixed cam shape. Therefore, it is impossible to adjust the amount of a gas that is being introduced or exhausted.

If the valve lift apparatus is designed for low driving speeds, the valve open time and amount are not sufficient for high speeds. On the other hand, if the valve lift apparatus is designed for high speeds, the opposite is true.

The above information disclosed in this Background section is only for enhancement of understanding of the background of the invention and therefore it may contain information that does not form the prior art that is already known in this country to a person of ordinary skill in the art.

SUMMARY OF THE INVENTION

A continuous variable valve lift apparatus includes an input cam disposed on an input shaft, a valve opening/closing portion, and a rocker arm rotating shaft. A rocker arm rotates around the rocker arm rotating shaft corresponding to a rotation of the input cam. An output cam is disposed at an end of the rocker arm, and opens and closes the valve opening/closing portion. A control portion controls a position of the rocker arm rotating shaft.

The control portion may include a first link connected with the rocker arm rotating shaft, a second link connected with the first link, and a control unit that is connected with the second link and controls rotating displacements of the second link.

The apparatus may also include a control portion shaft connecting the second link with the control unit, a supporting portion for supporting the control portion shaft and the input shaft, and a rocker arm moving guide in the supporting portion for guiding the rocker arm rotating shaft.

The input cam may be disposed between the rocker arm and the control portion.

The valve opening/closing portion may include a swing arm, a valve connected with the swing arm, and a swing arm roller disposed on the swing arm for opening and closing the valve corresponding to reciprocating movements of the output cam.

The rocker arm moving guide may be a constant distance from a center of the swing arm roller when the valve is closed.

The output cam may include a first portion and a second portion. A cross-section of the first portion, which contacts the swing arm roller, may be a constant distance from the rocker arm rotating shaft, and a cross-section of the second portion, which contacts the swing arm roller, may be away from the rocker arm rotating shaft.

The apparatus may also include a rocker arm roller at an end of the rocker arm for contacting the input cam.

The apparatus may also include a return spring disposed such that the input cam and the rocker arm contact each other.

The control portion may include a third link for controlling displacements of the rocker arm rotating shaft, and a control unit that is connected with the third link and controls rotating displacements of the third link.

The apparatus may also include a control portion shaft connecting the third link with the control unit, a supporting portion for supporting the control portion shaft and the input shaft, and a rocker arm moving guide in the supporting portion for guiding the rocker arm rotating shaft.

The control portion may include a variable lever connected with a variable lever shaft, and a control unit connected with the variable lever shaft. The variable lever may rotate around the variable lever shaft by control of the control unit and control displacements of the rocker arm shaft.

DESCRIPTION OF REFERENCE NUMERALS INDICATING PRIMARY ELEMENTS IN THE DRAWINGS

Figure 1:
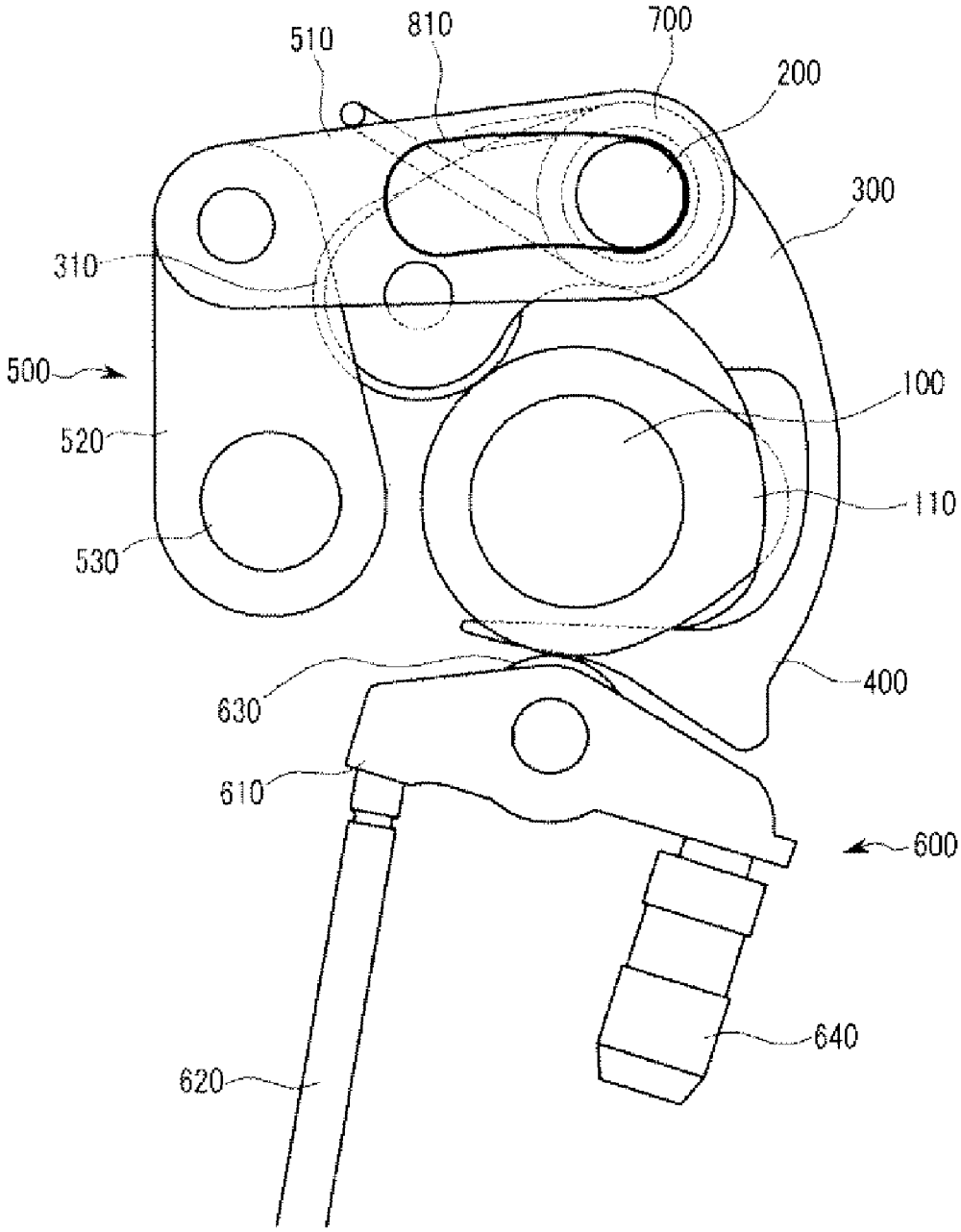
FIG. 1 is a front view of a continuous variable valve lift apparatus according to A first exemplary embodiment of the present invention.
Figure 2:
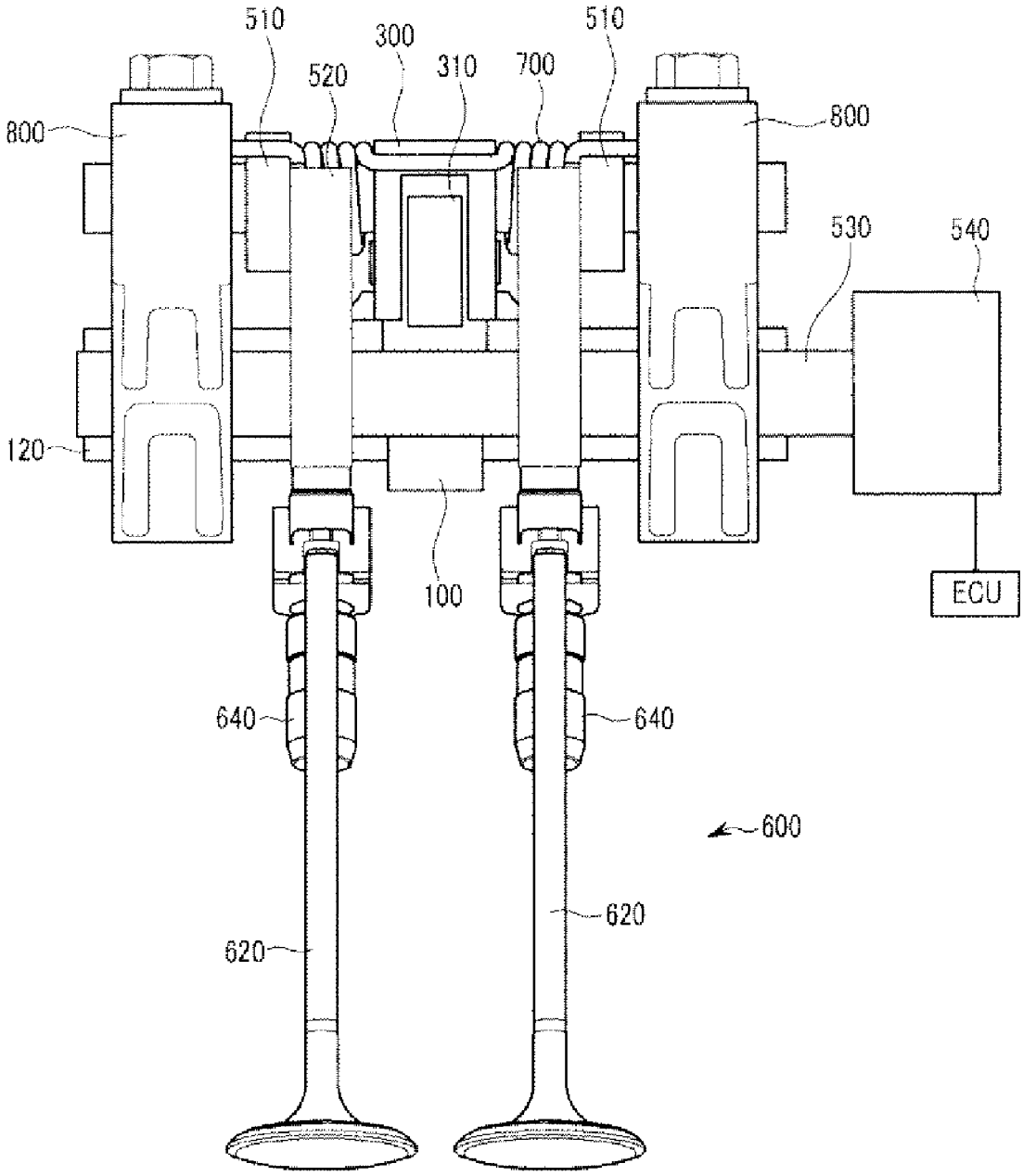
FIG. 2 is a side view of the continuous variable valve lift apparatus of FIG. 1.

| | |
|---|---|
| 100, 101: input cam | 110: lobe |
| 120, 121: input shaft | 200, 201: rocker arm rotating shaft |
| 300, 301: rocker arm | 310, 311: rocker arm roller |
| 400, 401: output cam | 410: the first portion |

-continued

| | |
|---|---|
| 420: second portion | 500, 501: control portion |
| 510: first link | 520: second link |
| 530: control portion shaft | 540, 541: control unit |
| 550: third link | 600, 601: valve opening/closing portion |
| 610: swing arm | 620: valve |
| 630: swing arm roller | 640: hydraulic lash adjuster |
| 700: return spring | 800: supporting portion |
| 810: rocker arm moving guide | |

DETAILED DESCRIPTION OF PREFERRED EMBODIMENTS

Exemplary embodiments the present invention will be described more fully hereinafter with reference to the accompanying drawings.

Referring to FIG. 1 to FIG. 4, an input cam 100 is provided to an input shaft 120, and a rocker arm 300 is disposed around the input cam 100. The rocker arm 300 reciprocatingly rotates around a rocker arm rotating shaft 200 corresponding to a rotation of the input cam 100. An output cam 400 is provided at an end of the rocker arm 300.

A valve opening/closing portion 600 is disposed below the input cam 100. The valve opening/closing portion 600 includes a swing arm 610, a valve 620 connected with the swing arm 610, and a swing arm roller 630 provided on the swing arm 610 for opening and closing the valve 620 corresponding to reciprocating movements of the output cam 400. The swing arm 610 is supported by a hydraulic lash adjuster (HLA) 640.

A control portion 500 adjusts a position of the rocker arm rotating shaft 200. The control portion 500 includes a first link 510 connected with the rocker arm rotating shaft 200, a second link 520 connected with the first link 510, and a control unit 540 that is connected with the second link 520 and controls rotating displacements of the second link 520.

The control unit 540 is controlled by an ECU (electronic control unit, not shown) on the basis of a load of an engine, vehicle speed, and so on. The control unit 540 may be include motor, an actuator, etc, and can be designed and implemented by a person of ordinary skill in the art based on the teachings herein. The ECU may include a processor, memory, and associated hardware, software, and/or firmware that may be selected and programmed by a person of ordinary skill in the art based on the teachings herein.

The second link 520 is connected with the control unit 540 by a control portion shaft 530. The control portion shaft 530 and the input shaft 120 are supported by a supporting portion 800. A rocker arm moving guide 810 is provided in the supporting portion 800 for guiding the rocker arm rotating shaft 200. The input cam 100 is disposed between the rocker arm 300 and the control portion 500; thus, the total height and volume of the continuous variable valve lift apparatus are small.

The rocker arm moving guide 810 is a constant distance from the center of the swing arm roller 630 when the valve 620 is closed. A rocker arm roller 310 is provided at an end of the rocker arm 300 for contacting the input cam, providing smooth operation.

A return spring 700 is provided for the input cam 100 and the rocker arm 300 to contact each other.

Figure 4:
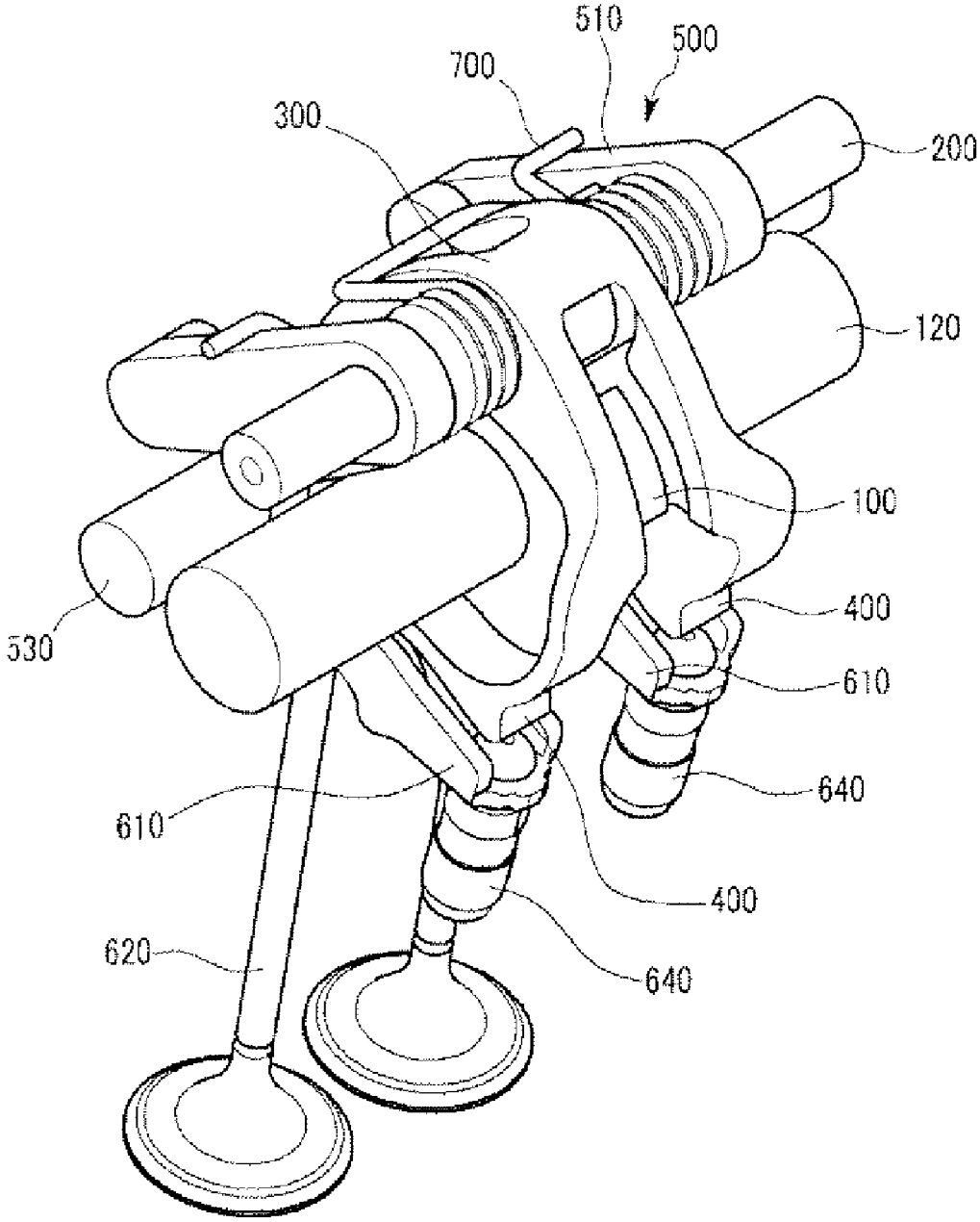

As shown in FIG. 4, there may be several valve opening/closing portions 600 and several output cams 400. The number can be selected by a person of ordinary skill in the art according to the size of the engine etc.

Figure 5:
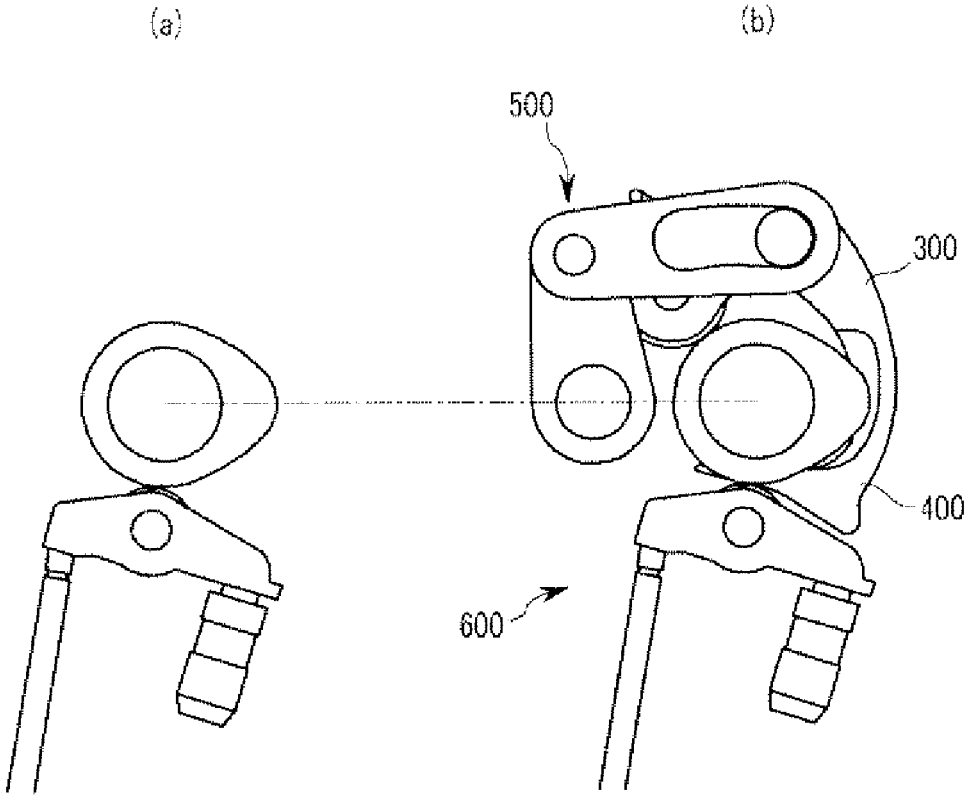
FIG. 5 is a view comparing the continuous variable valve lift apparatus of FIG. 1 to a typical lift apparatus.

Referring to FIG. 5, the continuous variable valve lift apparatus according to the first exemplary embodiment of the present invention may use a conventional camshaft.

Figure 6:
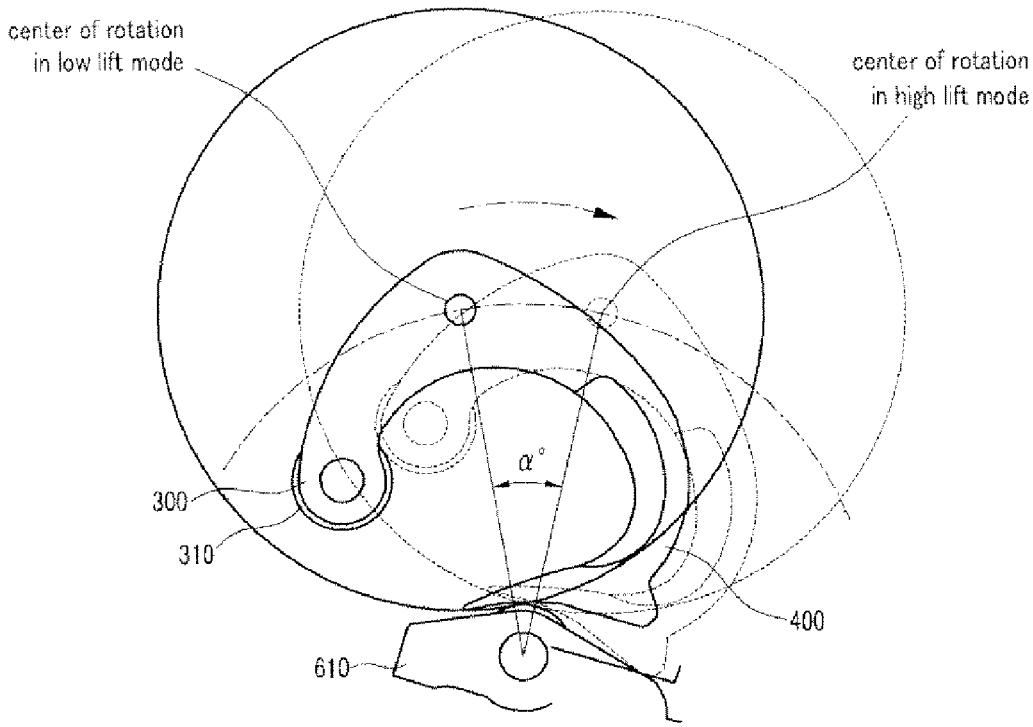
FIG. 6 is a schematic view illustrating operation of the continuous variable valve lift apparatus of FIG. 1.
Figure 6:
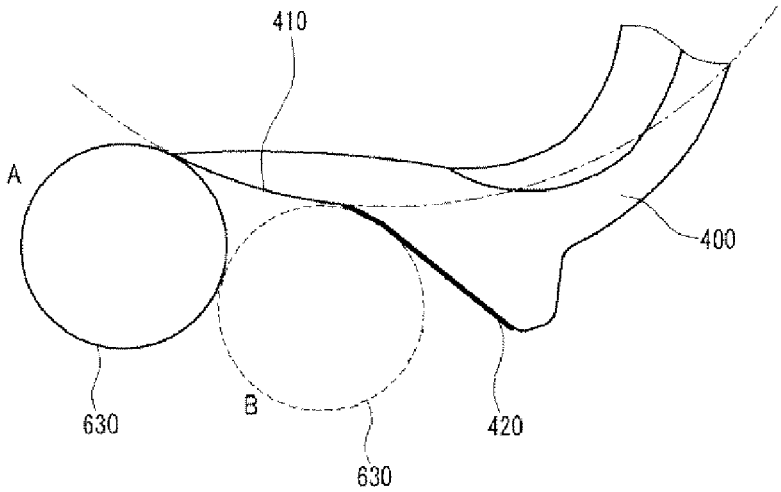

In FIG. 6(*a*), the rocker arms 300 in a high lift mode and a low lift mode are shown.

A dotted line circle that encircles the rocker arm rotating shaft 200 in the high lift mode and a solid line circle that encircles the rocker arm rotating shaft 200 in the low lift mode are shown, and the rocker arm 300 reciprocates along partial circles. "α" indicates an angle between the centers of rotation in the high lift mode and the low lift mode.

In FIG. 6(*b*), "A" indicates a relative position of the swing arm roller 630 in the low lift mode, and "B" indicates a relative position of the swing arm roller 630 in the high lift mode.

The output cam 400 includes a first portion 410 and a second portion 420, and a cross-section of the first portion 410 is a constant distance from the rocker arm rotating shaft 200.

Thus, the valve 620 is not opened when the first portion 410 contacts the swing arm roller 630 and me rocker arm 300 rotates around the rocker arm rotating shaft 200 in the clockwise direction.

A cross-section of the second portion 420 is formed in a direction away from the rocker arm rotating shaft 200.

Thus, the valve 620 is opened when the second portion 420 contacts the swing arm roller 630 and the rocker arm 300 rotates around the rocker arm rotating shaft 200 in the clockwise direction.

Referring to FIG. 1, when the lobe 110 of the input cam 100 rotates and passes by the rocker arm roller 310, the rocker arm 300 rotates around the rocker arm rotating shaft 200 counterclockwise by the return spring 700.

In the low lift mode, a relative position of the swing arm roller 630 is "A" when the valve 620 is closed. Despite rotation of the rocker arm 300, the valve 620 maintains a closed state at some intervals when the first portion 410 contacts the swing arm roller 630 and the valve 620 is opened when the second portion 420 contacts the swing arm roller 630. Thus, time and lift amounts of valve opening are reduced.

On the other hand, in the high lift mode, a relative position of the swing arm roller 630 is "B" when the valve 620 is closed. The second portion 420 is close to the swing arm roller 630 and the valve is immediately opened when the rocker arm 300 rotates. Thus, time and lift amounts of valve opening are increased.

The design of the output cam may vary according to the kind of a vehicle or required performance, and if an interval of the first portion is increased, CDA (cylinder deactivation) can be achieved.

Figure 7:
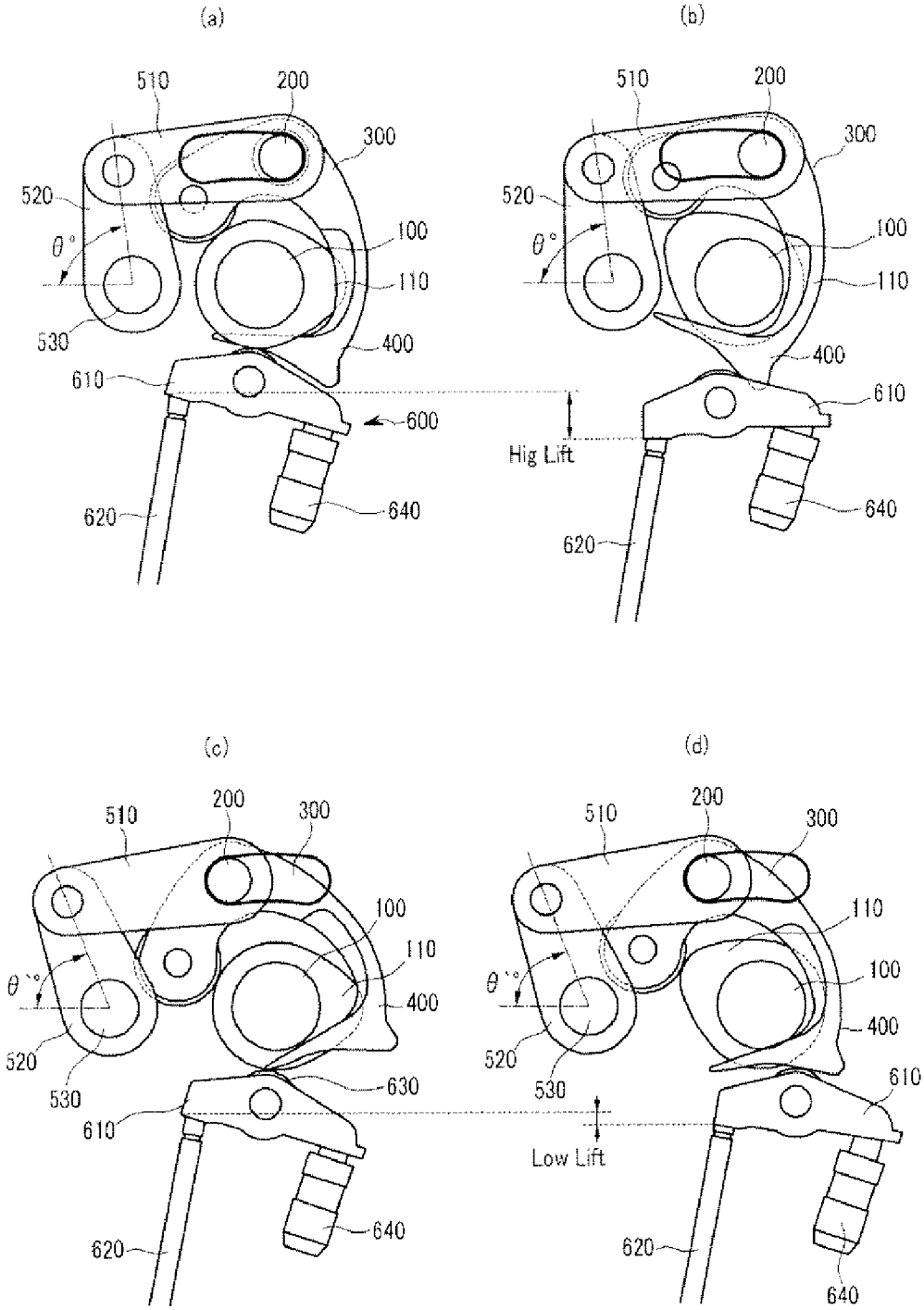
FIG. 7 is a view similar to FIG. 6, comparing a low lift mode and a high lift mode.

FIG. 7(*a*) to FIG. 7(*d*) explain the principle of the operation of FIG. 6. FIG. 7(*a*) and FIG. 7(*b*) show the high lift mode, and ⊖ indicates a relative angle between horizontal and the second link 520. FIG. 7(*c*) and FIG. 7(*d*) show the low lift mode, and ⊖' indicates a relative angle between horizontal and the second link 520. FIG. 7(*a*) and FIG. 7(*c*) show the valve in a closed state, and FIG. 7(*b*) and FIG. 7(*d*) show the valve in an open state.

As shown in FIG. 7, the rocker arm 300 reciprocates between constant angles, but times and lift amounts of valve opening are variable according to a position of the second link 520.

Figure 8:
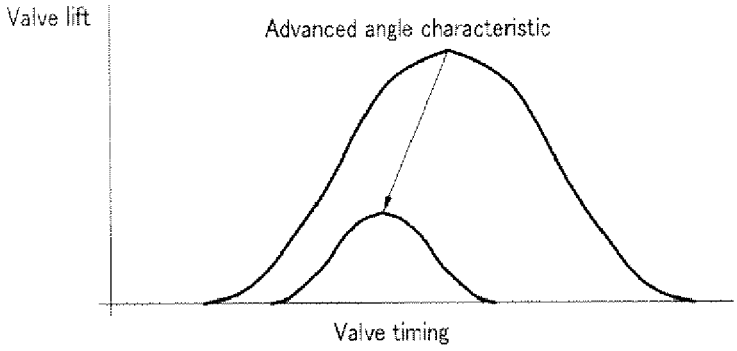
FIG. 8 illustrates advanced angle characteristic of valve timing of the continuous variable valve lift apparatus of FIG. 1 when a valve lift is changed.

FIG. 8 is a view showing advanced angle characteristics of valve timing of the continuous variable valve lift apparatus according to the first exemplary embodiment of the present invention when a valve lift is changed. If the valve lift mode is changed from the high lift mode to the low lift mode as shown in FIG. 7, the rocker arm rotates in the opposite direction of rotation direction of the input cam, so that a peak point of the valve profile is advanced.

Figure 9:
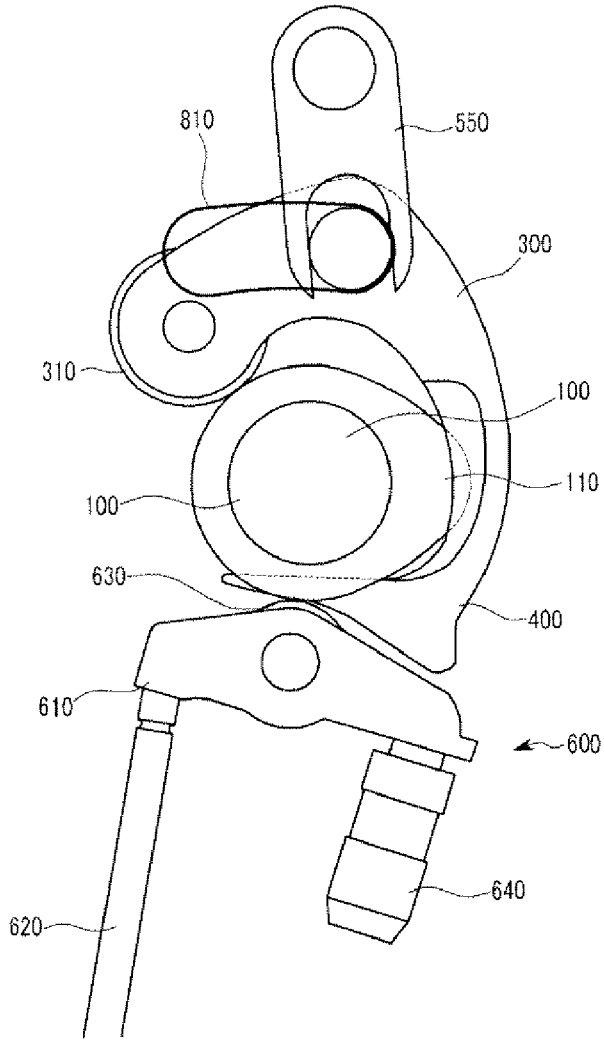
FIG. 9 is a front view of a continuous variable valve lift apparatus according to a second exemplary embodiment of the present invention.

As shown in FIG. 9, in a second exemplary embodiment, the first link 510 and the second link 520 of the control portion 500 are replaced with a third link 550. The other elements shown here have the same reference numbers as in the first exemplary embodiment.

As shown in FIG. 9, the third link 550 is connected with the rocker arm rotating shaft 200 for adjusting a position of the rocker arm rotating shaft 200. The third link 550 is connected with the control unit 540 for adjusting rotating displacements of the third link 550, the same as in FIG. 2.

Figure 3:
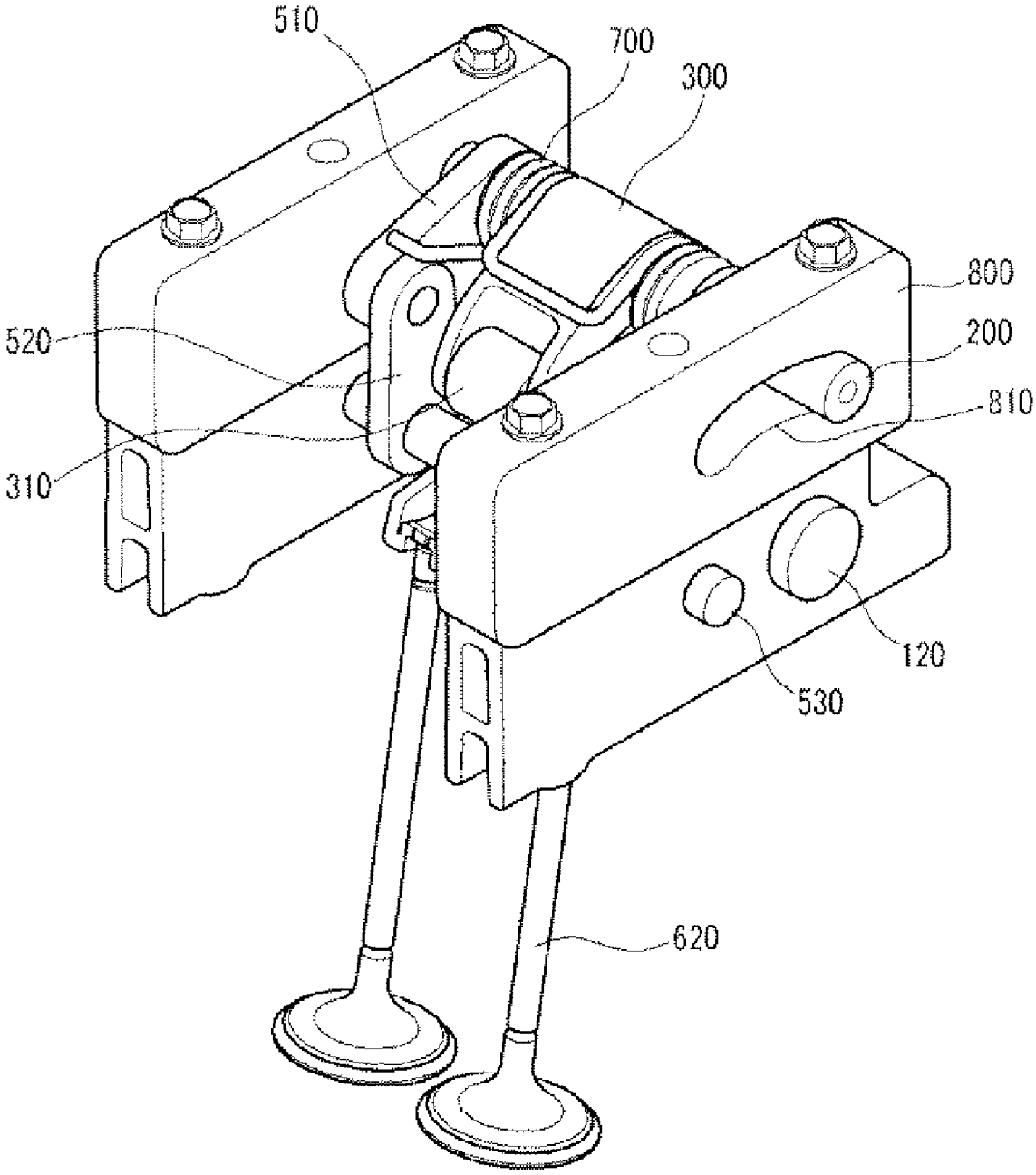
FIG. 3 and FIG. 4 are perspective views of the continuous variable valve lift apparatus of FIG. 1.

Referring to FIG. 3, the continuous variable valve lift apparatus according to the second exemplary embodiment of the present invention includes a supporting portion 800 and a rocker arm moving guide 810 in the supporting portion 800, and the rocker arm rotating shaft 200 is guided along the rocker arm moving guide 810 the same as in the continuous variable valve lift apparatus according to the first exemplary embodiment of the present invention.

Other elements are the same as the continuous variable valve lift apparatus according to the first exemplary embodiment of the present invention, so detailed explanations thereof will be omitted.

Figure 10:
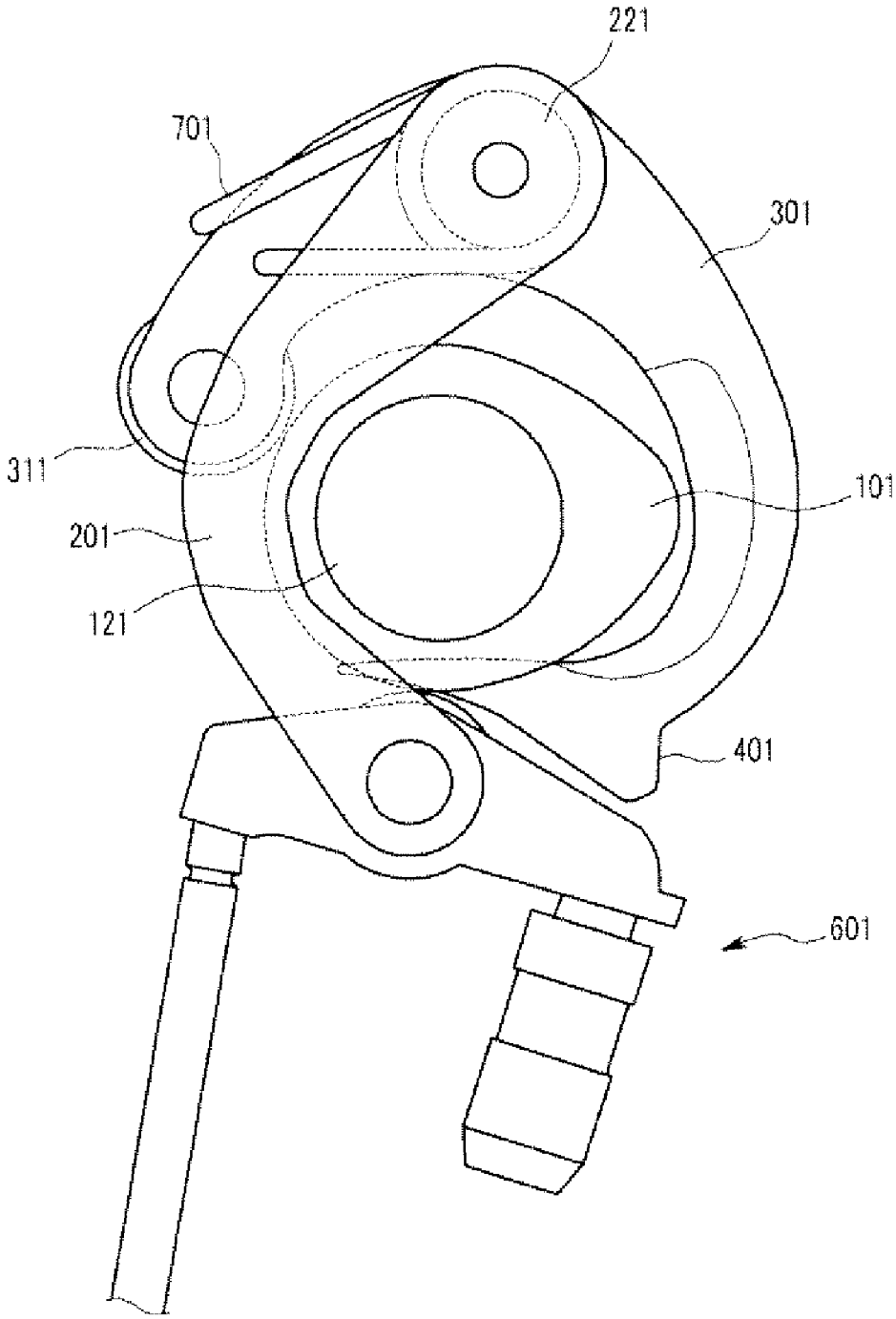
FIG. 10 is a front view of a continuous variable valve lift apparatus according to a third exemplary embodiment of the present invention.
Figure 11:
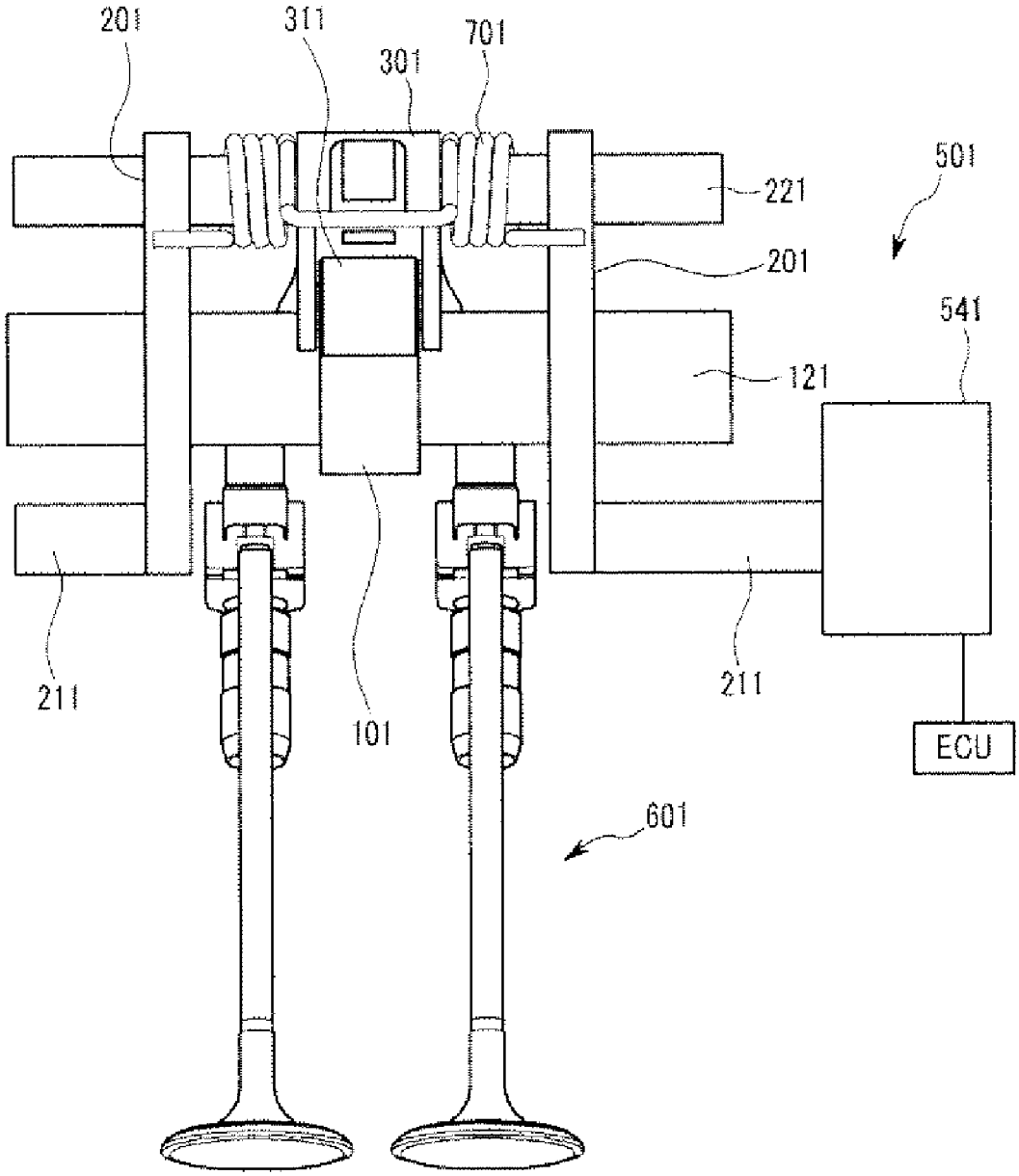
FIG. 11 is a side view of the continuous variable valve lift apparatus of FIG. 10.
Figure 12:
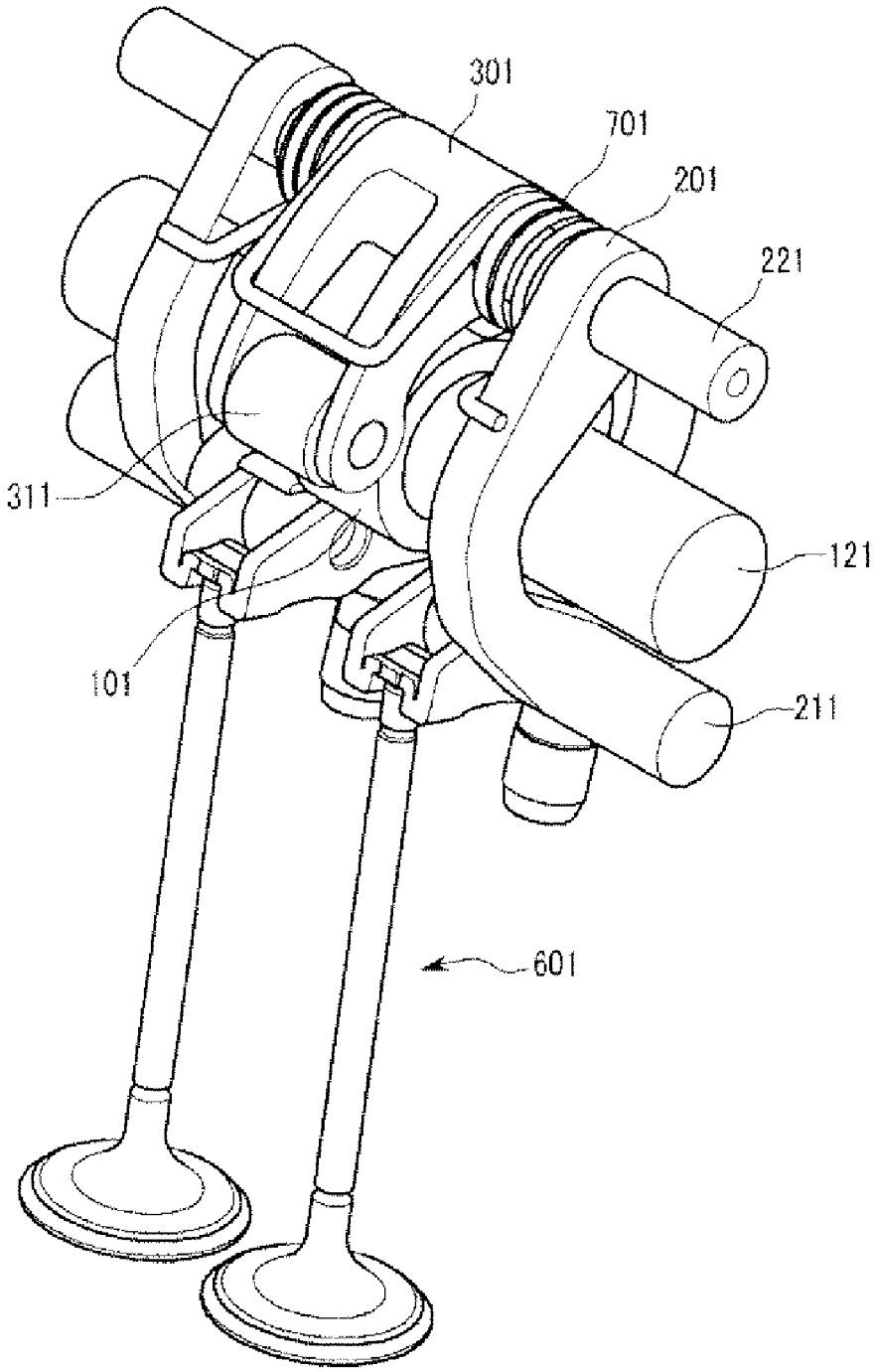
FIG. 12 is a perspective view of the continuous variable valve lift apparatus of FIG. 10.

Referring to FIGS. 10-12, the continuous variable valve lift apparatus according to a third exemplary embodiment of the present invention includes an input cam 101 on an input shaft 121, a valve opening/closing portion 601, a rocker arm rotating shaft 221, a rocker arm 301 that rotates around the rocker arm rotating shaft 221 corresponding to a rotation of the input cam 101, an output cam 401 that is disposed at an end of the rocker arm 301 and opens and closes the valve opening/closing portion 601, and a control portion 501 that controls a position of the rocker arm rotating shaft 221.

The control portion 501 includes a variable lever 201 connected with a variable lever shaft 211 and a control unit 541 connected with the variable lever shaft 211. The variable lever 201 rotates around the variable lever shaft 211 by control of the control unit 541, and controls displacements of the rocker arm shaft 301. That is, the rocker arm rotating shaft 221 is adjusted.

A rocker arm roller 311 is disposed at an end of the rocker arm 301 for contacting the input cam 101. A return spring 701 is provided for the input cam 101 and the rocker arm 301 to contact each other. The input cam 101 is disposed between the rocker arm 301 and the variable lever 201.

Other elements and an operation principle of the continuous variable valve lift according to the third exemplary embodiment of the present invention are the same as the continuous variable valve lift apparatus according to the first exemplary embodiment of the present invention, so detailed explanation will be omitted.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims.

What is claimed is:

1. A continuous variable valve lift apparatus comprising:
- an input cam disposed on an input shaft;
- a valve opening/closing portion;
- a rocker arm rotating shaft;
- a rocker arm that rotates around the rocker arm rotating shaft corresponding to a rotation of the input cam;
- an output cam that is disposed at an end of the rocker arm and opens and closes the valve opening/closing portion; and
- a control portion that controls a position of the rocker arm rotating shaft,
- wherein the control portion comprises:
  - a first link connected with the rocker arm rotating shaft;
  - a second link connected with the first link; and
  - a control unit that is connected with the second link and controls rotating displacements of the second link.

2. The continuous variable valve lift apparatus of claim 1, further comprising:
- a control portion shaft connecting the second link with the control unit;
- a supporting portion for supporting the control portion shaft and the input shaft; and
- a rocker arm moving guide in the supporting portion for guiding the rocker arm rotating shaft.

3. The continuous variable valve lift apparatus of claim 2, wherein the input cam is disposed between the rocker arm and the control portion.

4. The continuous variable valve lift apparatus of claim 3, wherein the valve opening/closing portion comprises:
- a swing arm;
- a valve connected with the swing arm; and
- a swing arm roller disposed on the swing arm for opening and closing the valve corresponding to reciprocating movements of the output cam.

5. The continuous variable valve lift apparatus of claim 4, wherein the rocker arm moving guide is a constant distance from a center of the swing arm roller when the valve is closed.

6. The continuous variable valve lift apparatus of claim 4, wherein the output cam comprises a first portion and a second portion; and wherein:
- a cross-section of the first portion, which contacts the swing arm roller, is a constant distance from the rocker arm rotating shaft; and
- a cross-section of the second portion, which contacts the swing arm roller, is away from the rocker arm rotating shaft.

7. The continuous variable valve lift apparatus of claim 6, further comprising a rocker arm roller at an end of the rocker arm for contacting the input cam.

8. The continuous variable valve lift apparatus of claim 7, further comprising a return spring disposed such that the input cam and the rocker arm contact each other.

9. A continuous variable valve lift apparatus comprising:
- an input cam disposed on an input shaft;
- a valve opening/closing portion;
- a rocker arm rotating shaft;
- a rocker arm that rotates around the rocker arm rotating shaft corresponding to a rotation of the input cam;
- an output cam that is disposed at an end of the rocker arm and opens and closes the valve opening/closing portion; and
- a control portion that controls a position of the rocker arm rotating shaft,
- wherein the control portion comprises:
  - a third link for controlling displacements of the rocker arm rotating shaft; and
  - a control unit that is connected with the third link and controls rotating displacements of the third link.

10. The continuous variable valve lift apparatus of claim 9, further comprising:
- a control portion shaft connecting the third link with the control unit;

a supporting portion for supporting the control portion shaft and the input shaft; and a rocker arm moving guide in the supporting portion for guiding the rocker arm rotating shaft.

11. The continuous variable valve lift apparatus of claim 10, wherein the input cam is disposed between the rocker arm and the control portion.

12. The continuous variable valve lift apparatus of claim 11, wherein the valve opening/closing portion comprises:

a swing arm;

a valve connected with the swing arm; and a swing arm roller disposed on the swing arm for opening and closing the valve corresponding to reciprocating movements of the output cam.

13. The continuous variable valve lift apparatus of claim 12, wherein the rocker arm moving guide is a constant distance from a center of the swing arm roller when the valve is closed.

14. The continuous variable valve lift apparatus of claim 13, wherein the output cam comprises a first portion and a second portion; and wherein:

a cross-section of the first portion, which contacts the swing arm roller, is a constant distance from the rocker arm rotating shaft; and a cross-section of the second portion, which contacts the swing arm roller, is away from the rocker arm rotating shaft.

15. The continuous variable valve lift apparatus of claim 14, further comprising a rocker arm roller at an end of the rocker arm for contacting the input cam.

16. The continuous variable valve lift apparatus of claim 15, further comprising a return spring disposed such that the input cam and the rocker arm contact each other.

17. A continuous variable valve lift apparatus comprising:

an input cam disposed on an input shaft;

a valve opening/closing portion;

a rocker arm rotating shaft;

a rocker arm that rotates around the rocker arm rotating shaft corresponding to a rotation of the input cam;

an output cam that is disposed at an end of the rocker arm and opens and closes the valve opening/closing portion; and a control portion that controls a position of the rocker arm rotating shaft, wherein the control portion comprises:

a variable lever connected with a variable lever shaft; and a control unit connected with the variable lever shaft, wherein the variable lever rotates around the variable lever shaft by control of the control unit and controls displacements of the rocker arm shaft.

18. The continuous variable valve lift apparatus of claim 17, further comprising a rocker arm roller at an end of the rocker arm for contacting the input cam.

19. The continuous variable valve lift apparatus of claim 18, further comprising a return spring disposed such that the input cam and the rocker arm contact each other.

20. The continuous variable valve lift apparatus of claim 19, wherein the input cam is disposed between the rocker arm and the variable lever.

* * * * *